US008235018B2

(12) United States Patent
Dorn et al.

(10) Patent No.: US 8,235,018 B2
(45) Date of Patent: Aug. 7, 2012

(54) TAPPET

(75) Inventors: Stefan Dorn, Hollfeld (DE); Norbert Geyer, Hochstadt (DE); Karsten Kucht, Burghaslach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 219 days.

(21) Appl. No.: 12/723,797

(22) Filed: Mar. 15, 2010

(65) Prior Publication Data

US 2010/0229812 A1 Sep. 16, 2010

(30) Foreign Application Priority Data

Mar. 13, 2009 (DE) ..... 10 2009 013 132

(51) Int. Cl.
*F01L 1/14* (2006.01)

(52) U.S. Cl. ..... 123/90.48; 123/90.5; 123/90.52

(58) Field of Classification Search ..... 123/90.48, 123/90.5, 90.52; 74/567, 569
See application file for complete search history.

(56) References Cited

U.S. PATENT DOCUMENTS 7,143,731 B2 * 12/2006 Kirbach et al. ..... 123/90.48

FOREIGN PATENT DOCUMENTS

DE 102006057246 6/2008

* cited by examiner

*Primary Examiner* — Ching Chang
(74) *Attorney, Agent, or Firm* — Volpe and Koenig, P.C.

(57) ABSTRACT

A tappet (1), either for a high-pressure fuel pump or for a valve train of an internal combustion engine, with a housing (2) whose driven side (3) used for a contact of a tappet-following part forms a contact on a bottom side (4) of a bridge part (6) projecting through an inner casing (5) of the housing (2). An anti-rotation locking device (10) projects past the outer casing (8) of the housing with a first cylinder section (9) and sits in a window (7) of the housing (2), with this anti-rotation locking device (10) being provided as a cylindrical element, and tab-like projections (13) project from peripheral walls (11) of the window (7) and the anti-rotation locking device (10), standing "loose" in the window (7), snaps behind these projections. A second cylinder section (14) of the anti-rotation locking device extends behind the inner casing (5) of the housing (2), and the bridge part (6), extending on an axial section of the anti-rotation locking device (10), has in its peripheral section a recess (15) in its outer surface (16), with the second cylinder section (14) of the anti-rotation locking device (10) being supported against this recess.

13 Claims, 3 Drawing Sheets

TAPPET

CROSS-REFERENCE TO RELATED APPLICATIONS

This application claims the benefit of German Patent Application No. 10 2009 013 132.9, filed Mar. 13, 2009, which is incorporated herein by reference as if fully set forth.

FIELD OF THE INVENTION

The invention relates to a cam-following or eccentric-following tappet, either for a high-pressure fuel pump or for a valve train of a quality-regulated or quantity-regulated internal combustion engine, with an essentially cylindrical housing whose driven side used as a contact for a tappet-following part contacts a bottom side of a bridge piece projecting through an inner casing of the housing and wherein an anti-rotation locking device projecting past the outer casing of the housing with a first cylinder section extends in a window of the housing.

BACKGROUND OF THE INVENTION

Such a tappet, here for stroke activation of a pump piston of a fuel pump, emerges from DE 10 2006 057 246 A1. A pin that has a mushroom-like cross section and that is pressed into a window of a housing of the tappet is used as an anti-rotation locking device for its housing.

In this construction it is disadvantageous that the press fit can possibly cause an undesired influence or deformation of the surrounding housing material. In addition, it is clear that this region must have very tight tolerances, in order to guarantee the desired press fit under all conditions. For unfavorable tolerance fields, it can result that the anti-rotation locking device is lost. Overall, the above construction has proven relatively expensive with regard to assembly and cost expenditures.

SUMMARY

The object of the invention is therefore to create a tappet of the type noted above in which the listed disadvantages are eliminated. In particular, the objective of the invention is to create a tappet whose anti-rotation locking device is held captively without affecting the surrounding material and that can simultaneously be produced economically.

According to the invention, this objective is met in that an element that is at least similar in shape to a cylinder is applied as an anti-rotation locking device, wherein tab-like projections project into the window, with the anti-rotation locking device, standing "loose" relative to and in the window, snaps behind the projections and extends, with a second cylindrical section, behind the inner casing of the housing, and wherein a bridge piece, extending on an axial section of the anti-rotation locking device, has, in its peripheral section, a recess in its outer surface against which the second cylindrical section of the anti-rotation locking device is supported.

Due to the cylinder-like element guided with slight play according to the invention as an anti-rotation locking device, the disadvantages named above are eliminated. The anti-rotation locking device snapped radially behind the retaining tabs (either of the window or the one-part radial extension of the bridge piece) can no longer be lost during handling or operation of the tappet. Simultaneously, due to the "loose" guidance of the anti-rotation locking device, there is no longer an undesired effect on the surrounding area. A simple assembly of the anti-rotation locking device has proven conceivable for a completed tappet (after hardening and grinding processes).

The above tappet that is proposed, in a realization of the invention, as a roller or sliding tappet, can be activated, for example, by an eccentric or a cam on its drive side that can sit on the end of a camshaft of a valve train of the internal combustion engine (pump tappet). It is also conceivable and provided, however, to apply the lift-generating device to any arbitrary shaft of the internal combustion engine, such as a compensation shaft or crankshaft (pump tappet). In the case of the use of the tappet in a valve train of an internal combustion engine, this tappet could communicate with a cam or a camshaft at the top or bottom.

The proposed tab-like projections of the window, wherein these projections are generated in one refinement of the invention, for example, by a simple swaging process, can project from the peripheral or axial walls of the window. For producing the tab-like projections, it is also conceivable to mount, clip, etc. a separate component, such as a thin-walled sheet part, in the window, with this component having the tab-like, snap-on projections.

However, a standard part, such as a needle roller or a cylinder roller from the roller bearing sector is not exclusively imagined as the anti-rotation locking device. It is also conceivable and provided to use a cylinder pin, a fitted key, or a tubular section. If necessary, anti-rotation locking devices could also be used that deviate from a cylindrical shape.

As provided according to one embodiment of the invention, a radially inward directed support of the anti-rotation locking device is realized in a recess of the bridge piece projecting through the inner casing of the housing. For excellent alignment of the anti-rotation locking device, in all of the variants, the recess can have, for example, in general, an arc-shaped profile, such as a gothic or v-shaped profile. For the case that the bridge piece is produced separately, this can be made from, for example, a sheet-plate material.

For mounting of the separate bridge piece in at least one direction, very generally, steps can be provided on holding tabs, with these steps being generated, among other things, through shape forming, such as swaging or embossing. The bridge piece can be snapped behind these tabs and can be held there, e.g., so that it can move slightly. Obviously, an attachment method, such as welding, soldering, bonding, or clamping is also imagined.

A roller or a sliding surface supported on a bolt is provided as the counter running surface for the eccentric or the cam on a drive side of the tappet. Bearing eyes for mounting the bolt can run in diametrically opposed flat sections of the housing. These flat sections also reinforce the housing, so that, if needed, mass can be spared. In addition, the flat sections could also be raised apart from the drive side like a roof.

In the case of the use of a sliding surface as the counter running surface, this could likewise be raised like a roof running on the drive side of the housing and a deposited anti-wear protective layer could be provided in this contact area.

A simple measure for an arrangement of the anti-rotation locking device is also provided. The anti-rotation locking device extends in the housing at an equivalent axial section as the flat sections but, in terms of the circumferential direction, outside of these flat sections. Thus, if needed, structural height on the housing can be spared.

Finally, it is provided to produce at least the housing from a steel plate in a deep-drawing or impact-extrusion method. This provides another contribution in the direction of lowering production costs.

BRIEF DESCRIPTION OF THE SEVERAL VIEWS OF THE DRAWINGS

The invention is explained in detail with reference to the drawingS. Shown are.

DETAILED DESCRIPTION OF THE PREFERRED EMBODIMENTS

Figure 1:
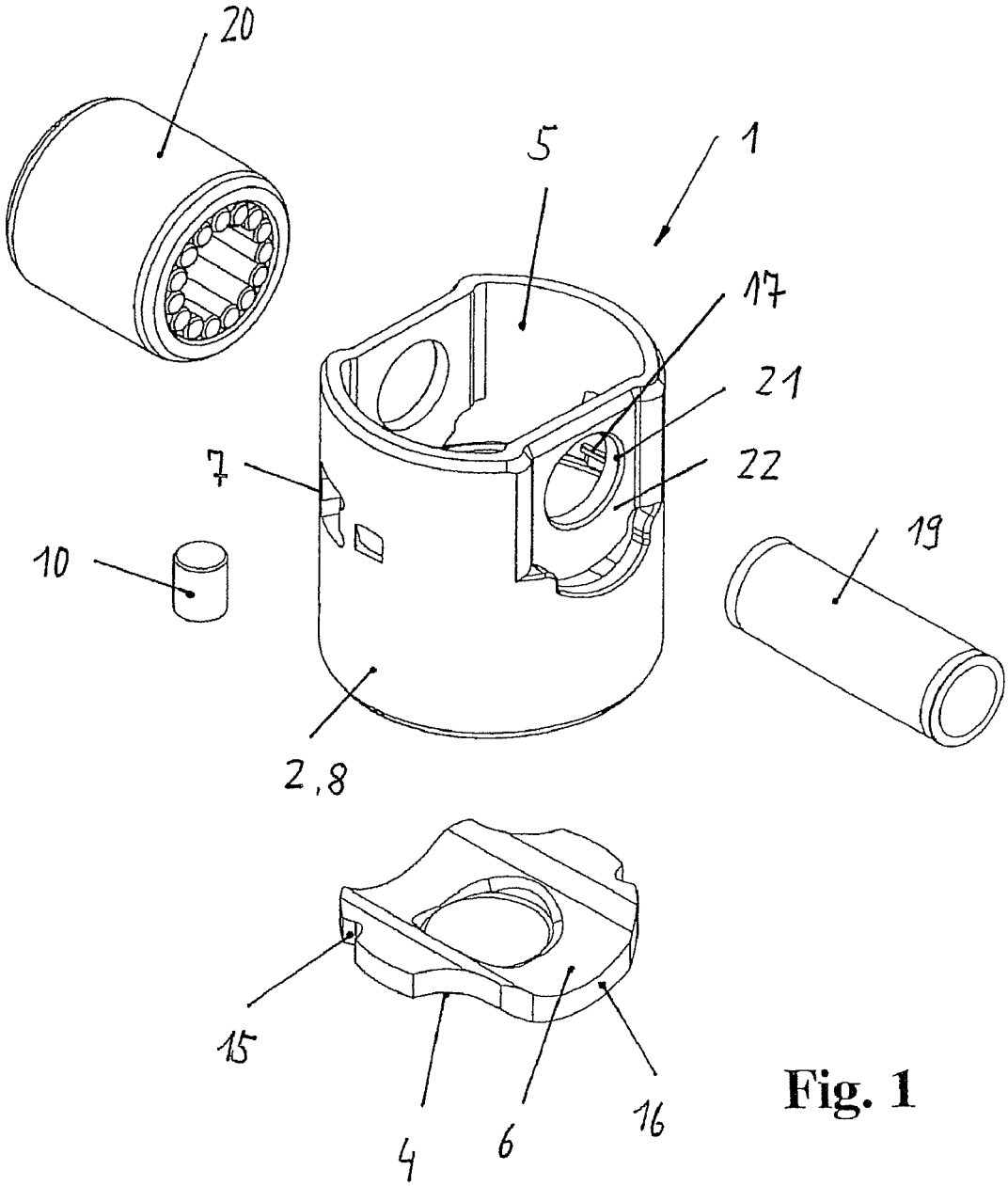
FIG. 1 is an exploded view of the tappet with an anti-rotation locking device according to the invention.
Figure 2:
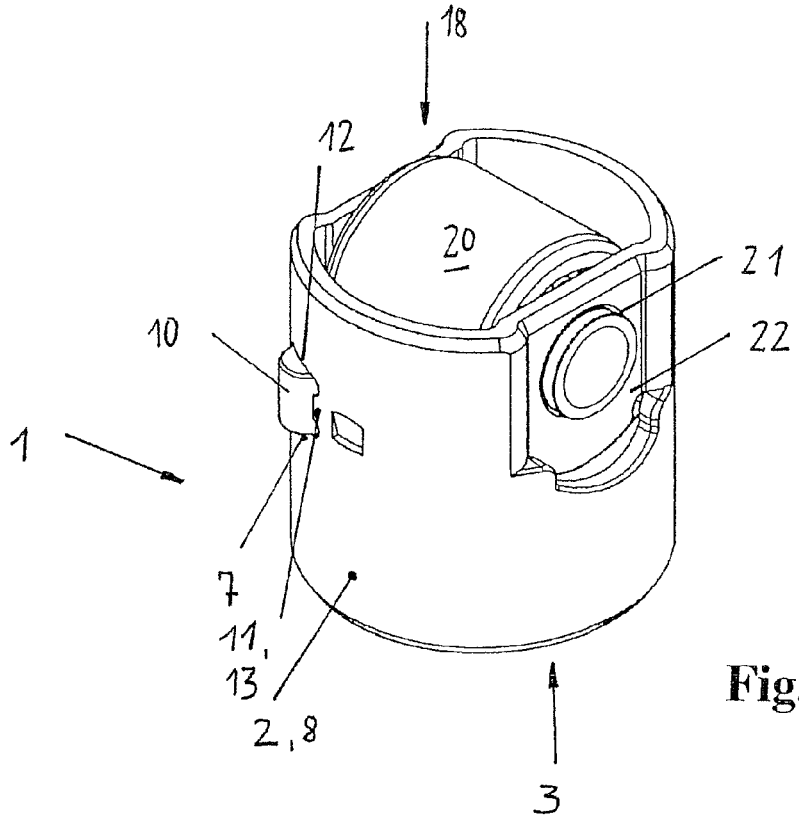
FIG. 2 is a perspective view of the tappet as above in its assembled state.
Figure 3:
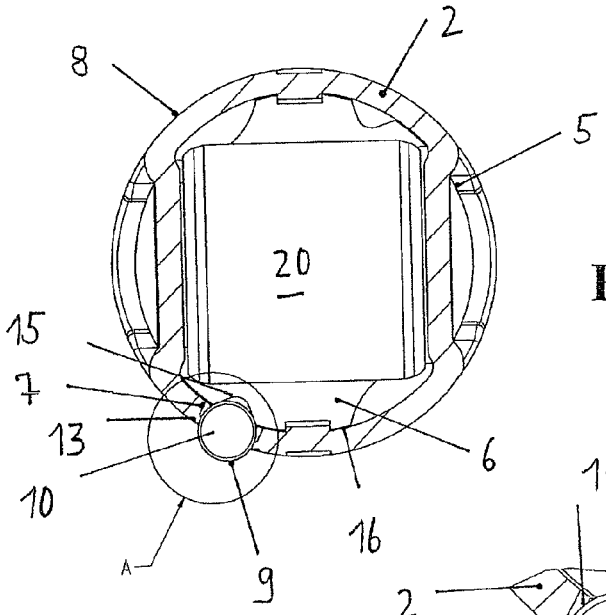
FIG. 3 is a cross-sectional view through the tappet in the region of its anti-rotation locking device.

Shown is a tappet 1, here constructed as a roller tappet for stroke actuation in a high-pressure fuel pump. The tappet 1 is made from an essentially cylindrical housing 2, on whose inner casing 5 a bridge piece 6 is secured in one direction by a simple connection 17, such as swaged connection (see FIG. 1). The bridge piece 6 projects cross-wise through the housing 2. A bottom side 4 of the bridge piece 6, where this bottom side 4 thus lies on a driven side 3 of the tappet 1, is used to form a contact with a pump piston of the high-pressure pump noted above. In the case of an insertion of the tappet 1 in a valve train, a gas-exchange valve or a push rod would contact this bottom side 4.

A drive side 18 of the housing 2 has two diametrically opposed flat sections 22. Each flat section 22 has a bearing eye 21. In the bearing eyes 21 sits a bolt 19 on which a needle-supported roller 20 runs. The roller 20 is used in a known way for following a lift generator (eccentric/cam). The bridge piece 6 snapped behind the connection 17 (swaged connection) contacts the bottom sides of the flat sections 22 in the other direction. It is clear that several, peripherally divided swaged connections (connections 17) could be provided for the bridge piece 6. The bridge piece 6 is advantageously held with slight play.

A window 7 is applied in the housing 2. This window is located at the height of the bridge piece 6. In the window 7 sits, according to the construction from FIGS. 1-4, an anti-rotation locking device 10. The latter is constructed, for example, as a cylinder pin. The anti-rotation locking device 10 sits with slight play relative to the peripheral and side walls 11, 12 of the window 7. If necessary, there can also be play only relative to one of the wall groups. On the inside in the radial direction, the anti-rotation locking device 10 is supported in a recess 15 in the outer surface 16 of the bridge piece 6.

Figure 4:
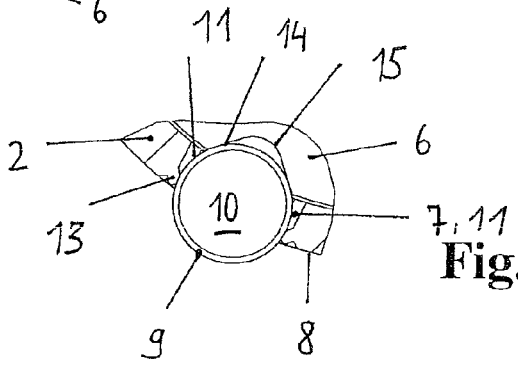
FIG. 4 is the detail A according to FIG. 3.
Figure 5:
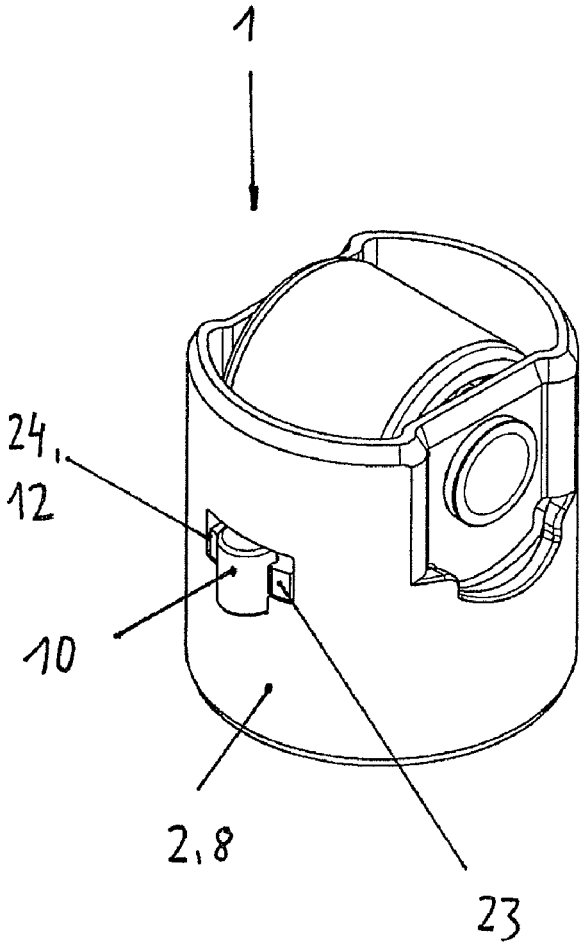
FIG. 5 is a view of a tappet similar to that according to FIG. 2, with an alternative variant of a guide of the anti-rotation locking device.
Figure 6:
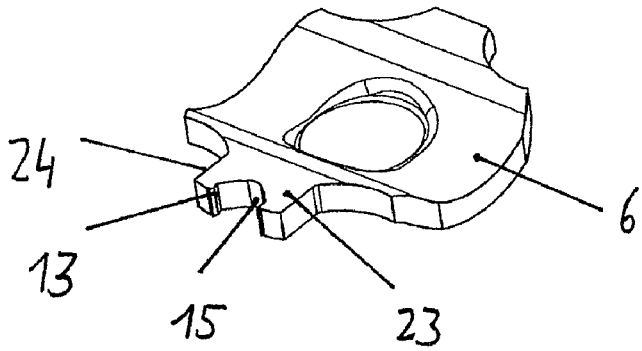
FIG. 6 is a view of the bridge piece according to FIG. 5.

As FIG. 4 discloses, the recess 15 of the bridge piece 6 has a gothic-arc profile. Simultaneously, tab-like projections 13 project from the peripheral walls 11 of the window 7 into the window 7 (FIG. 4). The projections 13 are created by swaging, embossing, or the like, at an edge region of the window 7.

The anti-rotation locking device 10 is assembled by snapping radially behind the tab-like projections 13, such that the second cylinder section 14 of the locking device forms a contact in the recess 15. A first cylinder section 9 of the anti-rotation locking device 10 projects past an outer casing 8 of the housing 2 and is guided, for installation of the tappet 1, in a longitudinal groove of a surrounding construction.

As an alternative to the construction according to FIGS. 1-4, FIGS. 5, 6 disclose a tappet 1 whose bridge piece 6 has a radial extension 23 attached in one piece in which the recess 15 lies with the snapped-in anti-rotation locking device 10. The radial extension 23 projects into the window 7 and, with its outer flanks 24, lies opposite the axial walls 12 of the window 7. Advantageously, in this area there is little play. Preferably, the radial extension 23 does not extend with its outer ends past the outer casing 8 of the housing 2.

Through the guidance of the anti-rotation locking device 10 with play in the window 7 and the accompanying possibility of making the tolerances larger, the production and assembly costs can be reduced. Simultaneously, it is obvious that there is no deformation/no stress build-up in the surrounding area of the housing 2.

The housing 2 and the bridge piece 6 are formed of a thin-walled sheet-plate material and are produced using a deep-drawing or stamping-bending technique. Cutting or impact-extrusion methods, however, are also possible.

LIST OF REFERENCE SYMBOLS

1) Tappet
2) Housing
3) Driven side
4) Bottom side
5) Inner casing
6) Bridge piece
7) Window
8) Outer casing of housing
9) First cylinder section
10) Anti-rotation locking device
11) Peripheral wall
12) Axial wall, side wall
13) Projection
14) Second cylinder section
15) Recess
16) Outer surface of bridge piece
17) Connection
18) Drive side
19) Bolt
20) Roller
21) Bearing eye
22) Flat
23) Radial extension
24) Outer flank

The invention claimed is:

1. Cam-following or eccentric-following tappet for an internal combustion engine, comprising an essentially cylindrical housing having a driven side that is adapted to contact of a tappet-following part formed by a bottom side of a bridge piece that extends across an inner casing of the housing, an anti-rotation locking device in a form at least similar to a cylinder projects past an outer casing of the housing and includes a first cylinder section that is located in a window of the housing, tab projections project into the window and the anti-rotation locking device, standing "loose" relative to and in the window, is snapped behind the projections, and a second cylinder section of the anti-rotation locking device extends behind the inner casing of the housing and wherein the bridge piece, extending on an axial section of the anti-rotation locking device, has in a peripheral section thereof a recess in its outer surface, with the second cylinder section of the anti-rotation locking device being supported against the recess.

2. The tappet according to claim 1, wherein the tab projections extend integrally from peripheral or axial walls of the window.

3. The tappet according to claim 2, wherein the tab projections are formed through shaping processes on the outer casing of the housing in an edge region of or in the window, and the projections extend out from the housing toward each other essentially with a roof shape.

4. The tappet according to claim 1, wherein the recess lies in a radial extension extending out integrally from the bridge piece, and the radial extension is adjacent, with outer flanks thereof, to axial walls of the window and includes, on insides thereof, the tab projections.

5. The tappet according to claim 1, wherein a molded piece comprising a needle or cylinder roller, a cylinder pin, or a piece of a pipe is applied as the anti-rotation locking device.

6. The tappet according to claim 1, wherein the recess of the bridge piece has a gothic, semi-cylindrical, cylinder-like, or v-shaped profile.

7. The tappet according to claim 1, wherein the bridge piece is constructed as a separate component and is held on the inner casing of the housing by at least one of a snap connection, swaged connection, bonded connection, press-fit connection, clamped connection, or welded connection.

8. The tappet according to claim 1, wherein the bridge piece is made from a thin-walled lightweight structural material.

9. The tappet according to claim 1, wherein a drive side of the housing is provided with a roller that is supported by cylinders or slides on a bolt.

10. The tappet according to claim 9, wherein the bolt sits on an end side in bearing eyes that extend on diametrically opposed flat sections of the housing.

11. The tappet according to claim 9, wherein the anti-rotation locking device extends on an axial section in the flat sections of the housing as well as peripherally outside of the flat sections.

12. The tappet according to claim 1, wherein a drive side of the housing is provided with a sliding surface.

13. The tappet according to claim 1, wherein the housing is a deep-drawn or an impact extruded steel plate.

* * * * *